US006060096A

United States Patent [19]

Hanson et al.

[11] Patent Number: 6,060,096

[45] Date of Patent: May 9, 2000

[54] MICROWAVEABLE BAG HAVING STAND-UP, WIDE MOUTH, FEATURES; AND, METHOD

[75] Inventors: Denise Ellen Hanson, Elk River; Eric Craig Jackson, Maple Grove, both of Minn.

[73] Assignee: Conagra, Inc., Omaha, Nebr.

[21] Appl. No.: 09/060,159

[22] Filed: Apr. 14, 1998

[51] Int. Cl.[7] ..... A23B 7/00

[52] U.S. Cl. ..... 426/107; 426/115; 426/118; 383/104; 219/727

[58] Field of Search ..... 426/107, 234, 426/115, 625, 627, 118; 383/104, 122; 219/727

[56] References Cited

U.S. PATENT DOCUMENTS

| | | | |
|---|---|---|---|
| 3,380,646 | 4/1968 | Doyen et al. | 383/104 |
| 3,851,574 | 12/1974 | Katz et al. | 426/107 |
| 4,548,826 | 10/1985 | Watkins | 426/394 |
| 4,571,337 | 2/1986 | Cage et al. | 426/107 |
| 4,691,374 | 9/1987 | Watkins et al. | 383/104 |
| 4,810,844 | 3/1989 | Anderson | 219/10.55 E |
| 5,008,024 | 4/1991 | Watkins | 219/10.55 |
| 5,044,777 | 9/1991 | Watkins et al. | 383/100 |
| 5,059,036 | 10/1991 | Richison et al. | 383/61 |
| 5,075,119 | 12/1991 | Mendenhall | 426/113 |
| 5,081,330 | 1/1992 | Brandberg et al. | 219/10.55 E |
| 5,097,107 | 3/1992 | Watkins et al. | 219/10.55 |
| 5,195,829 | 3/1993 | Watkins et al. | 383/100 |
| 5,211,975 | 5/1993 | Mendenhall et al. | 426/107 |
| 5,223,288 | 6/1993 | Mendenhall et al. | 426/107 |
| 5,294,765 | 3/1994 | Archibald et al. | 219/727 |
| 5,302,790 | 4/1994 | Turpin | 219/727 |
| 5,344,661 | 9/1994 | Mendenhall et al. | 426/107 |
| 5,474,383 | 12/1995 | Zuege et al. | 383/121 |
| 5,514,854 | 5/1996 | Atsaves | 219/727 |
| 5,650,084 | 7/1997 | Bley | 219/727 |

FOREIGN PATENT DOCUMENTS

| | | | |
|---|---|---|---|
| 2060812 | 11/1971 | Germany | 383/122 |

*Primary Examiner*—Nina Bhat
*Assistant Examiner*—Sherry A. Davermat
*Attorney, Agent, or Firm*—Merchant & Gould, P.C.

[57] ABSTRACT

A microwaveable bag having stand-up wide mouth features is provided. The microwaveable bag can be used in constructions including a microwave popcorn charge therein. The preferred construction is folded from a single sheet, preferably a multi-ply construction having a microwave interactive arrangement positioned between the two plies. After popping, the arrangement forms a self supporting bag with an open mouth for ease of access to popped popcorn.

12 Claims, 8 Drawing Sheets

MICROWAVEABLE BAG HAVING STAND-UP, WIDE MOUTH, FEATURES; AND, METHOD

FIELD OF THE INVENTION

The present invention relates to microwaveable packaging for food. In particular, it pertains to arrangements which contain food, to be microwave cooked. The particular, preferred, embodiments described concern arrangements for popping microwaveable popcorn. The preferred constructions have a wide mouth, in combination with a stand-up feature. Methods of assembly and use are provided.

BACKGROUND OF THE INVENTION

A wide variety of microwaveable food products are presently known. The ones of particular concern to the present disclosure are those in which the construction is used to pop microwaveable popcorn. In general, the related consumer product is a package which includes a popcorn charge. In use, the package, including the unpopped popcorn charge, is positioned appropriately in a microwave oven and is exposed to microwave energy. During the microwave process, the popcorn is popped and the bag expands.

Particular arrangements, to which the present disclosure relate, are those in which the package is flexible bag or pouch, which expands during the popping process. Expandable bag arrangements are described, for example, in U.S. Pat. Nos. 5,650,084; 5,302,790; 5,195,829; 5,081,330; 5,044,777; 4,691,374; and 4,548,826, the disclosures of which are incorporated herein by reference. Each of the patents identified above was developed by Golden Valley Microwave Foods of Edina, Minn. The present application was also developed by Golden Valley Microwave Foods of Edina, Minn.

Referring to U.S. Pat. No. 5,044,777 as an example, certain characteristics of the various microwaveable popcorn packaging described in these references are apparent. First, the bags are generally provided in a configuration having a pair of oppositely positioned side gussets used to separate the internal volume of the bag into first and second "tubes". When the arrangement is filled, generally the popcorn charge is placed in one of the two "tubes" and is substantially retained therein, prior to popping. This is shown, for example, in U.S. Pat. No. 5,044,777, FIG. 3.

Also, in general the unpopped popcorn charge is positioned in a center portion (typically about the center ⅓) of the arrangement. For many arrangements, during storage, the packaging arrangement is folded into a "trifold" configuration. This is apparent from the drawings and descriptions of U.S. Pat. Nos. 4,044,777, 5,195,829 and 5,650,084; and, it is specifically illustrated in U.S. Pat. No. 4,548,826 FIG. 5 and U.S. Pat. No. 4,691,374, FIGS. 3A and 14.

The type of bag constructions characterized in the references discussed above operate to form, when popped, a bag, which, after being open, is not "free standing". That is, typically the construction is such that after popping the popcorn is preferably poured out of the bag and into a bowl or other container for consumption. This is in part because the bags, once expanded by the popping popcorn, generally have narrow mouths and are rather long.

SUMMARY OF THE INVENTION

According to certain aspects of the present invention, a microwave popcorn bag arrangement is provided. The microwave popcorn bag arrangement preferably comprises a flexible bag which results from a single folded sheet construction. The term "single folded sheet construction" in this context, refers to a bag folded from a single, flexible, unitary member and not constructed from separate pieces. The "single unitary member" can be a single ply or a multiple ply laminate construction. In preferred arrangements, it is a multiple ply or multi-ply arrangement.

In general, the flexible bag includes first and second panels and a bottom gusset. The bottom gusset is positioned to, when collapsed, be directed inwardly as a two-walled gusset fold positioned between the first and second panels. When the bottom gusset is expanded, however, the bag can be stood upwardly with first and second panels projecting from a bottom formed by: the two-walled, base gusset; and, selected ends of the first and second panels.

Preferably, a microwave interactive construction is positioned on the first panel. In use, a popcorn charge is positioned over the microwave interactive construction, and within the bag. As the popcorn pops, the base gusset expands (the two walls open) and, under steam pressure, the bag vents. After the popping process is completed, the bag can be oriented to stand up on the base, with an open upper end for access to the popcorn.

In certain preferred constructions, each panel can be viewed as generally rectangular with first and second opposite ends, and first and second opposite side edges. Along the first ends, each panel is integrally joined to the base gusset member. Along the second ends, the two panels are secured to one another to form a fin seal. Preferably, the fin seal includes an unsealed "pocket" portion therein, which generates a vent, under steam and hot air pressure during popping. A preferred vent "pocket" of this type is viewable in the drawings.

Along a portion of the side edges, the first and second panels are sealed directly to one another. Along other portions of the first and second sides, the first and second panels are secured to the base gusset, which is positioned between the first and second panels. In preferred constructions, in this region, the base gusset is also secured directly to itself along the side edges. As a result, a stand-up base involving the base gusset, and the first ends (or bottom ends) of the first and second panels results.

A preferred pattern of adhesive is provided, which utilizes various internal seals in preferred manners to achieve desirable effects within the construction. These generally relate to tack seals that help keep the arrangement relatively tightly closed to ensure the positioning of the popcorn charge within an enclosed space near the microwave interactive construction, as popping is initiated, and to seals which provide desirable corners to the base. Preferred configurations for these seals are shown in the drawings.

Herein the term "corner seal" is generally meant to refer to a seal which extends in a diagonal direction across a corner defined between two generally orthogonal members, for example a base and an orthogonal side edge, or an end seal and a side seal.

DETAILED DESCRIPTION

Some Desirable Features for Microwave Popcorn Products.

As indicated in the background section above, while the arrangements of the recited patents have been used for successful products, there are certain features currently perceived to be desirable in certain microwave products that are not readily met by the characterized designs. In particular these are the features of: having an arrangement which is self-supporting after microwave popping, with an open end directed upwardly; and, providing an arrangement which has a large, wide, mouth so that the construction operates as its own "bowl" after popping.

Wide mouth containers having charges of unpopped popcorn therein, to be popped in microwave ovens, are known. Examples are described in U.S. Pat. Nos. 5,097,107 and 5,008,024, incorporated herein by reference. These patents are presently owned by the assignee of the present invention.

The arrangements of U.S. Pat. Nos. 5,097,107 and 5,008,024 generally involve rigid paperboard or cardboard constructions. That is, the outer "tub" is constructed of a relatively stiff, non-flexible, paperboard material, and is generally stored, prior to use, in the stand-up tub form or configuration. As a result, even with nesting features, the arrangements are relatively large and can take up substantial packaging space, store shelf space, and kitchen storage space.

The present invention concerns providing flexible packaging material in a conformation such that it can be folded for storage, with a charge of unpopped popcorn therein, into a relatively small package; and, which upon exposure to microwave energy in a microwave oven, will readily expand to generate an arrangement, having popped popcorn therein, which also has features of: being readily adjustable to be free standing on its own base; and, to having a relatively wide, upwardly directed, open mouth so that the popcorn can be readily reached by a consumer. Alternately stated, the flexible construction is such that, when expanded upon exposure to microwave energy, it forms its own bowl from which the popcorn can be eaten.

The Preferred Arrangement of the Figures

Figure 1:
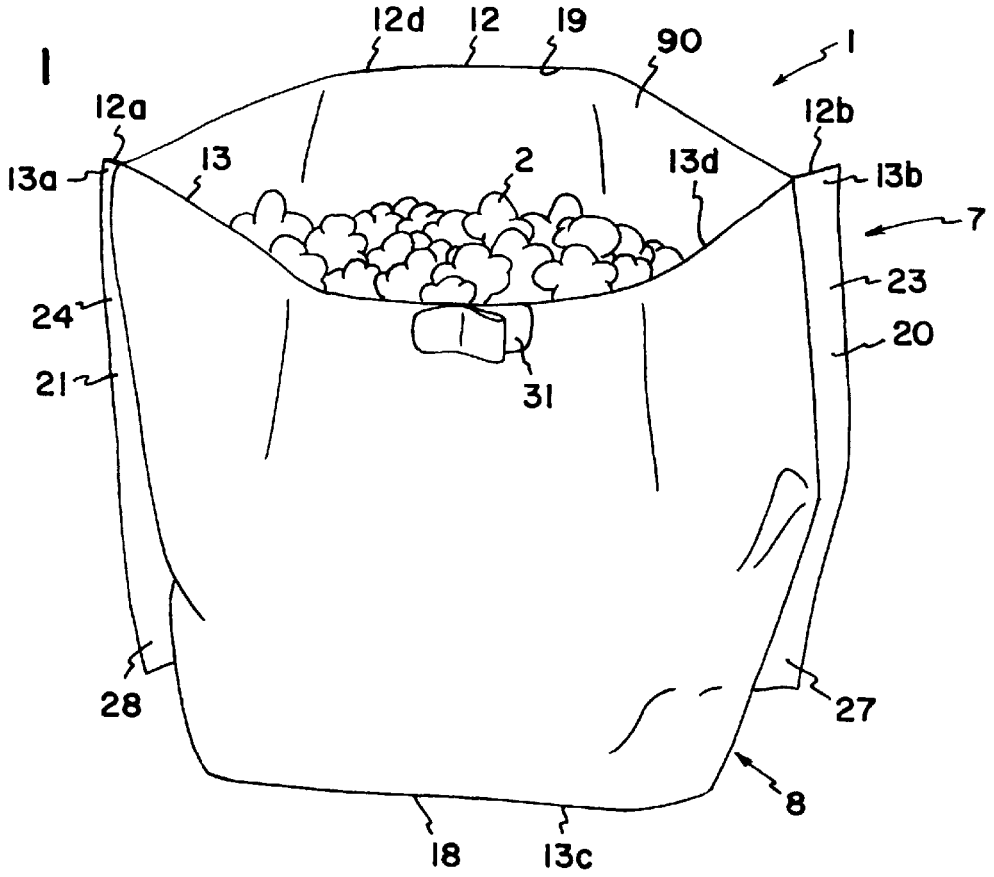
FIG. 1 is a perspective view of an arrangement according to one embodiment of the present invention; the arrangement of FIG. 1 being depicted in a stand-up orientation with popped popcorn inside.

The reference numeral 1, FIG. 1, depicts a microwaveable popcorn package according to the present invention. In FIG. 1, the popcorn package 1 is depicted as it would generally appear after a popcorn charge therein has been popped, forming popped popcorn 2, and also after the arrangement 1 has been opened and been oriented in a stand-up, self supporting, position. By "self supporting" in this context, it is meant that the arrangement or package 1 can be stood up in the orientation shown in FIG. 1, without needing to be held or supported in the upright position by a person or by some additional structure.

Figure 2:
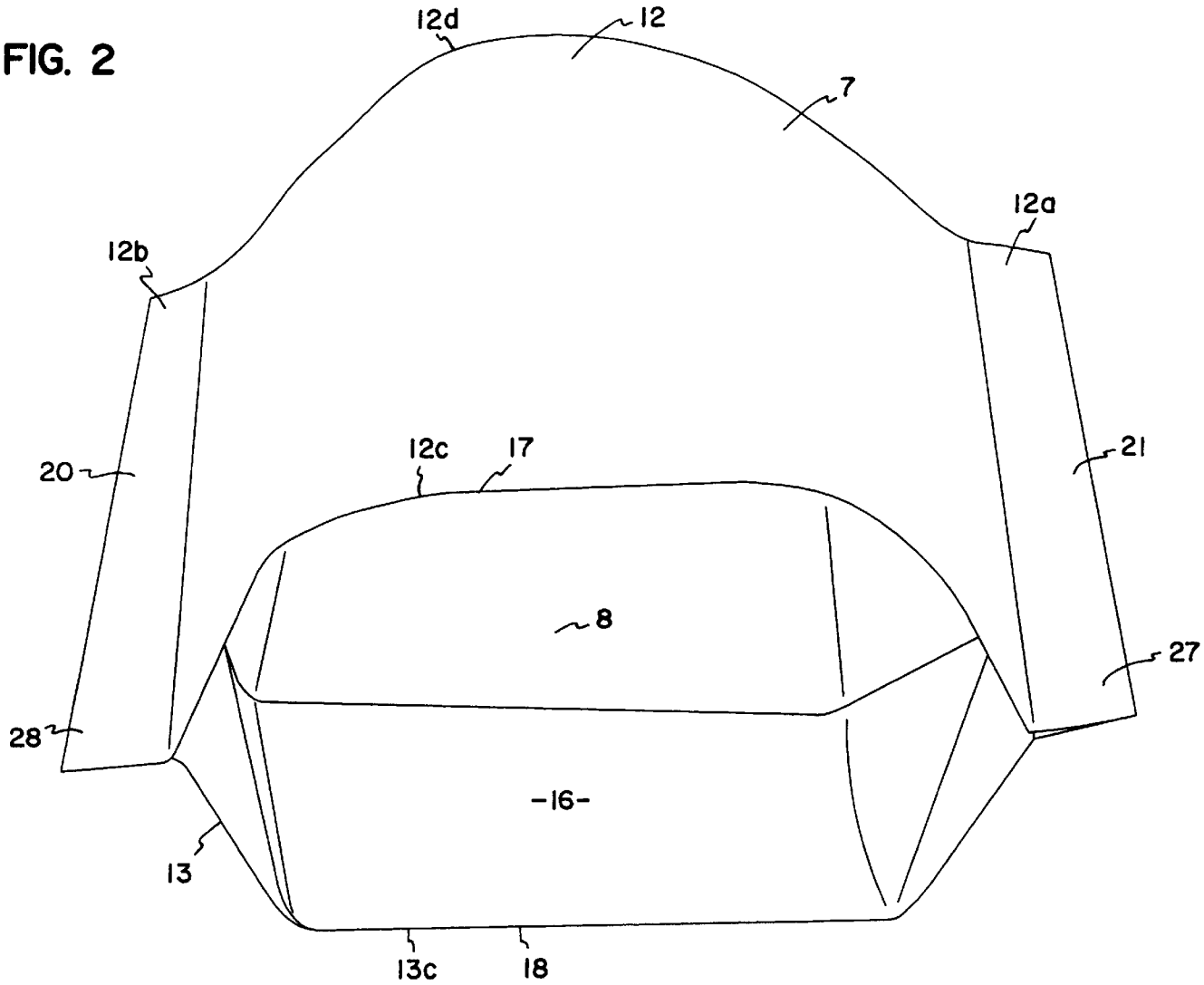
FIG. 2 is a bottom perspective view of the arrangement shown in FIG. 1.

Still referring to FIG. 1, the package 1, including popped popcorn 2 therein, has a sidewall structure 7 and a base or bottom structure 8 (FIG. 2). As will be further understood from descriptions provided herein below, the preferred package arrangement 1 has a sidewall structure 7 and base or bottom structure 8 resulting from the folding of a single sheet or blank construction, typically a multi-ply sheet. This will be better understood from the descriptions provided in connection with FIGS. 6–8. In general, this means that, in the preferred embodiment depicted, the sidewall structure 7 and base or bottom structure 8 are integral with one another, since each comprises a separate portion of a single-folded entity.

In general, FIG. 1, sidewall structure 7 comprises first and second panels or wall sections 12 and 13 respectively, oriented generally in juxtaposition with respect to one another.

Base structure 8 comprises a bottom gusset member 16, FIG. 2, positioned between lower portions 17 and 18 of wall panels 12 and 13. Each of the panels 12, 13, FIGS. 1 and 2, can be viewed as having first and second side edges 12*a*, 12*b*, 13*a*, 13*b* respectively and first and second end edges 12*c*, 12*d*, 13*c*, 13*d* respectively.

In general, after popping package 1 includes an upper, open, mouth 19, FIG. 1; and opposite side seals 20 and 21. Side seals 20 and 21 include upper seal portions 23 and 24 respectively; and lower seal portions 27 and 28 respectively, FIG. 1. In upper seal portions 23 and 24, wall panel 12 is sealed directly to wall panel 13 (side 12*a* is sealed directly to side 13*a*, and side 12*b* is sealed directly to side 13*b*). However, in lower seal portions 27 and 28, bottom gusset 16 (FIG. 2) is sealed between the wall panels 12 and 13, as explained below.

Figure 9:
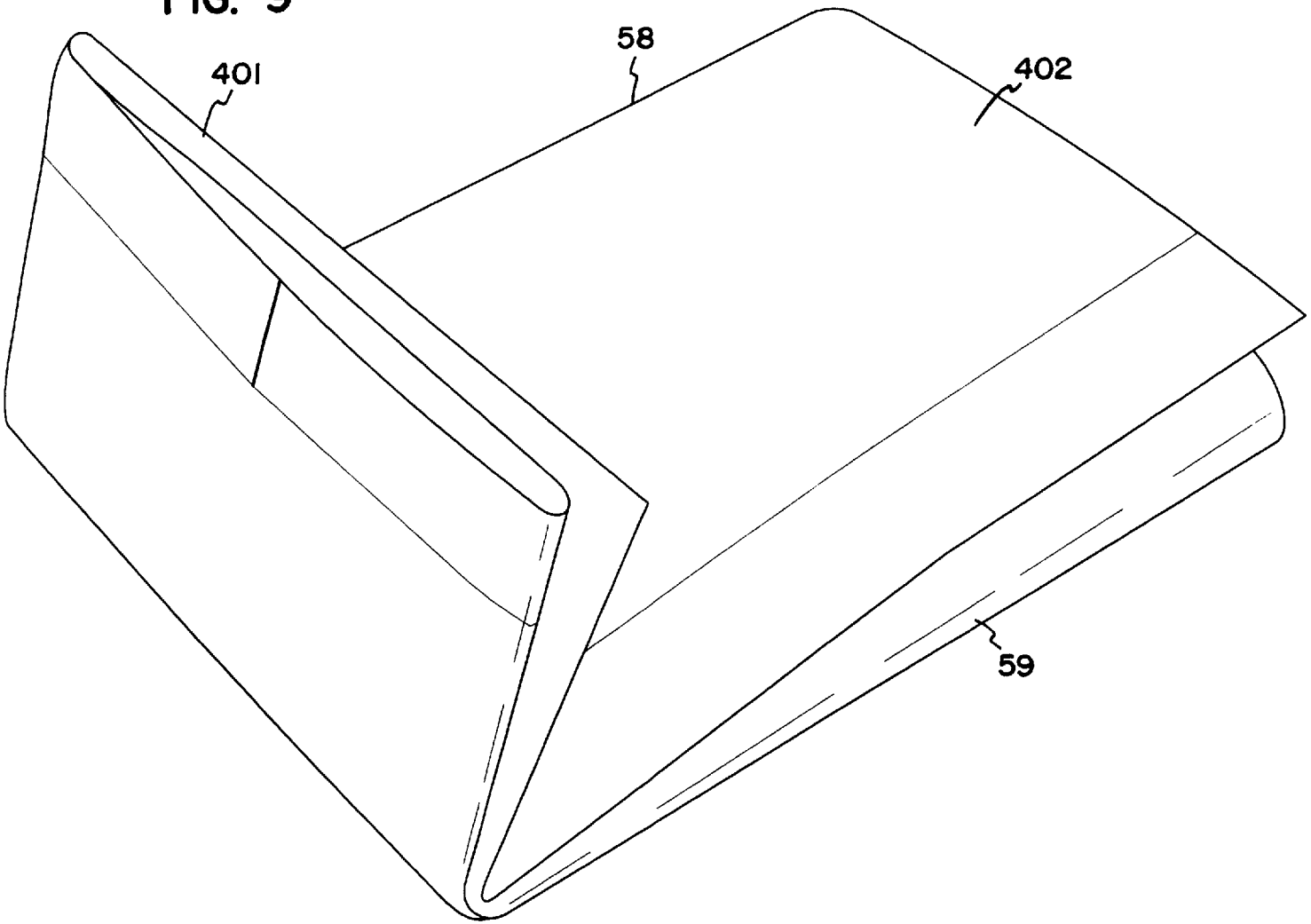
FIG. 9 is a schematic depiction of the arrangement of FIGS. 1–8 shown vertically folded for packaging and storage.
Figure 10:
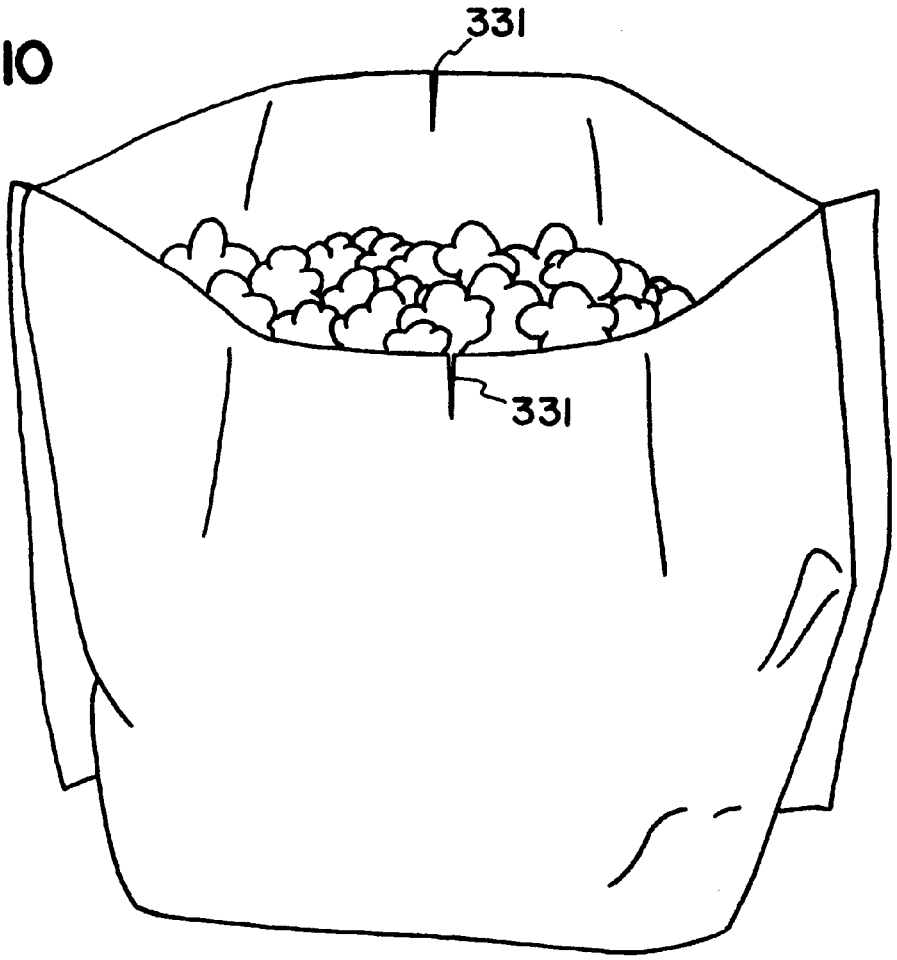
FIG. 10 is a schematic view of an alternate embodiment.

Still referring to FIG. 1, for the package 1 shown, a closure tab construction 31 is depicted. The closure tab construction 31 shown is a strip of polymeric substrate having a pressure sensitive, releasable, adhesive on one surface thereof, i.e. construction 31 is a strip of tape. As a result, the tab 31 can be operated as a reusable strip of tape to allow convenient reclosure of the package 1 for storage, if only a portion of the popcorn 2 therein is consumed. Thus, for example, after the popcorn 2 is partially eaten, the upper edges 12*d* and 13*d* of panels 12 and 13 can be pressed against one another by the user, and rolled or folded over to close the package 1. The closure tab construction 31, which prior to the rolling or folding action will have been removed from the panel 13 on which it is shown secured, would then be attached to the rolled or folded over top end of the package 1, and an adjacent portion of one of the side panels 12, 13, to keep the rolled or folded over portion closed. An alternate arrangement is shown in FIG. 10 in which notches or slits 331 can be folded to engage one another to keep the bag closed. (In other manners the arrangement of FIG. 10 is analogous to that of FIGS. 1–9.) It is noted that the slits 331 can also aid in venting during popping, and in opening after popping.

Figure 4:
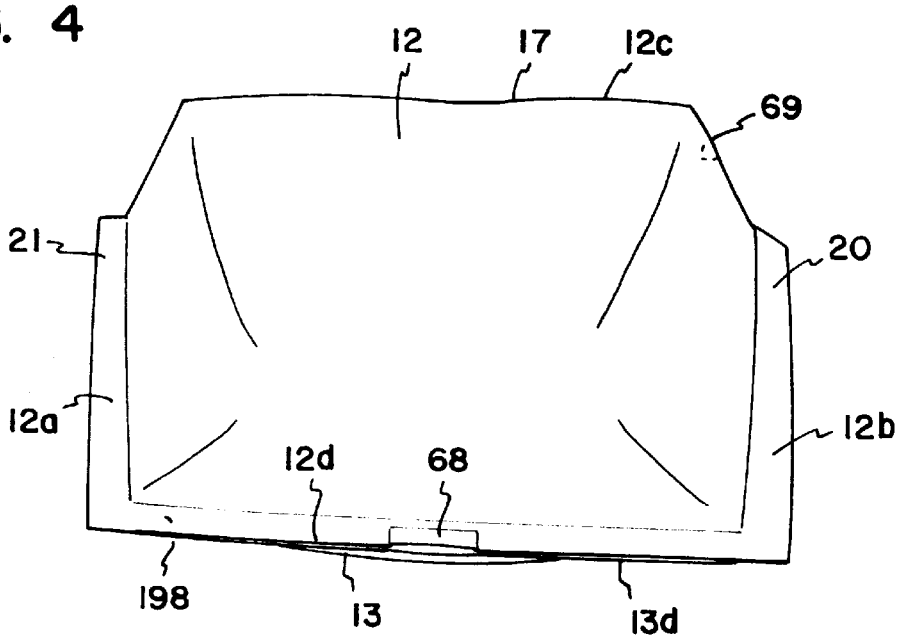
FIG. 4 depicts the arrangement of FIG. 3 after application of microwave energy thereto.
Figure 3:
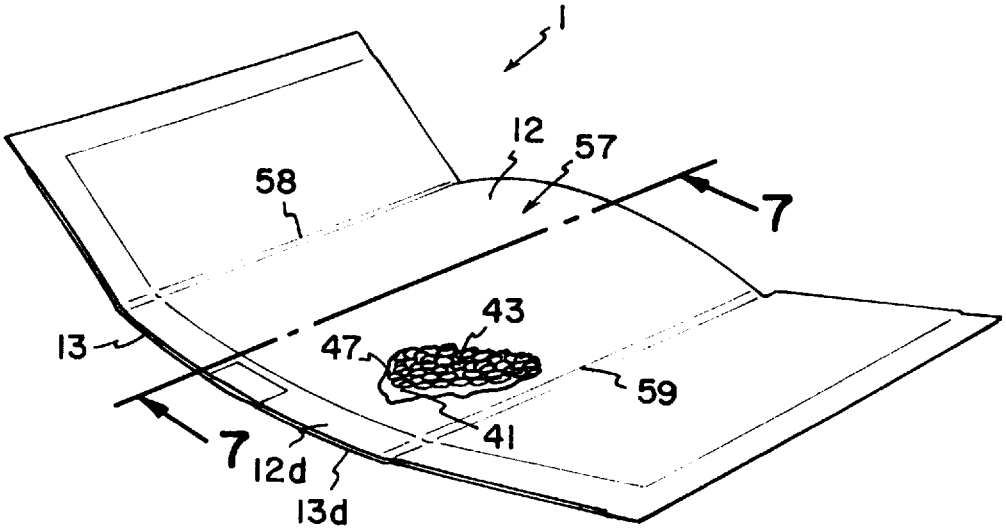
FIG. 3 is a perspective view of an arrangement according to the present invention shown having an unpopped popcorn charge therein; the construction of FIG. 3 being operable, upon application of appropriate microwave energy thereto, and following appropriate manipulation by a user, to form the construction depicted in FIGS. 1 and 2.
Figure 5:
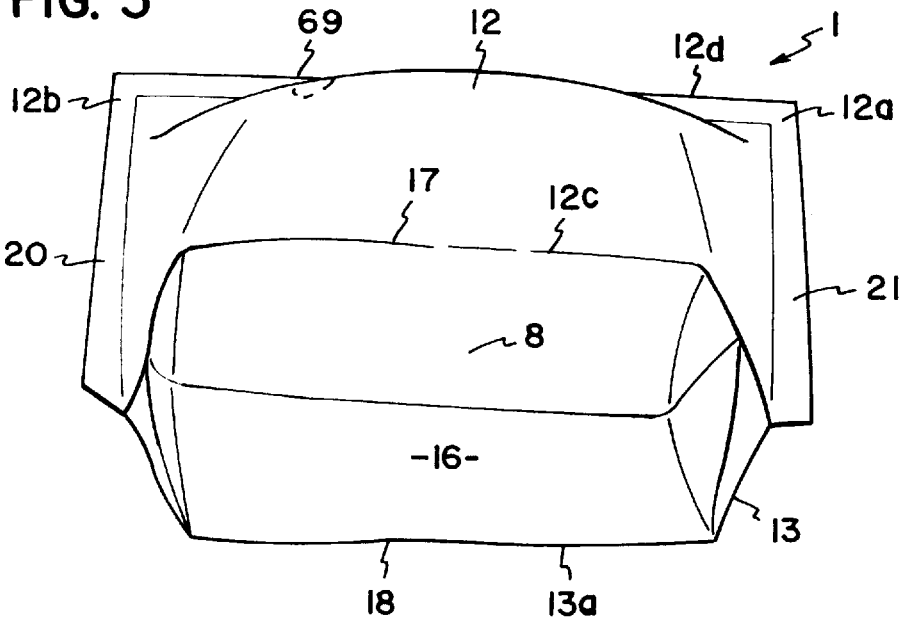
FIG. 5 is similar to FIG. 4, viewed from an opposite direction.

Attention is now directed to FIG. 3. In FIG. 3, the package 1 is depicted as it would generally appear when positioned in a microwave oven prior to a microwave popping process. In FIG. 3, the first and second opposite wall panels, 12 and 13, are visible. The bottom gusset 16 is shown substantially collapsed, FIG. 7. When configured as shown in FIG. 3, edges 12*d*, 13*d* of side walls 12, 13 are sealed to one another. Herein, when reference is made to a bag arrangement being in a "collapsed" configuration, reference is meant to a configuration analogous to that shown in FIGS. 3 and 7, with the gusset 16 collapsed in the panels 12, 13 laying collapsed substantially toward one another. When the arrangement is as shown in FIGS. 1 and 2, will generally be referred to as "expanded". This is the form of the arrangement which the bottom gusset 16 is expanded, and the panels 12, 13 are pushed away from one another, typically by the popped popcorn. In some instances in the "expanded" configuration, the package will be "open", as shown in FIGS. 1 and 2, or may be closed, as shown in FIGS. 4 and 5.

Figure 7:
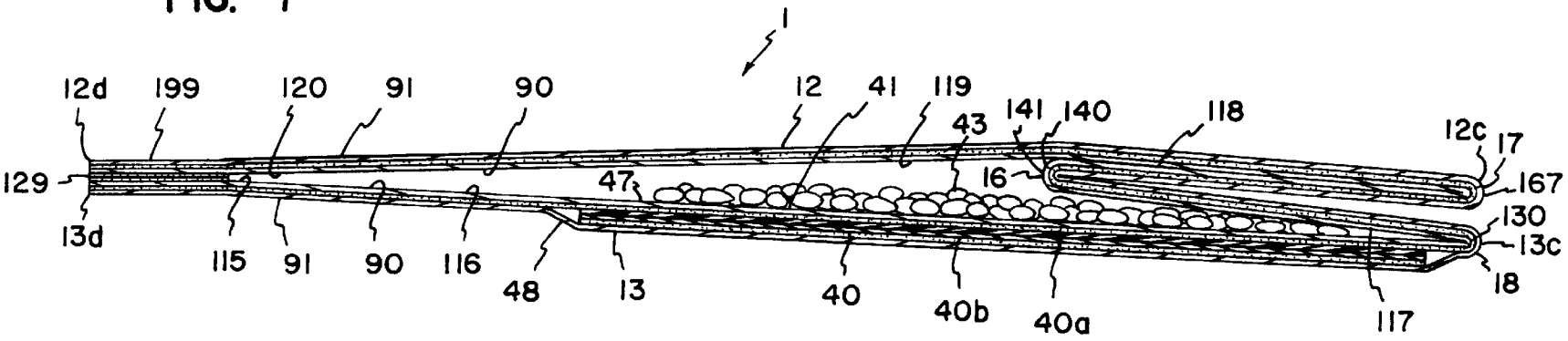
FIG. 7 is a schematic, cross-sectional view taken generally along line 7—7, FIG. 3.

Package 1 includes, positioned therein, a microwave interactive construction or susceptor 40, FIG. 7. Herein, the microwave interactive construction or susceptor will sometimes be referenced as positioned "on" a panel. By this it is meant that the susceptor is positioned on one of the two side walls or side panels 12, 13. The positioning "on" the panel may be by positioning on the inside of the bag, on the outside of the bag, or between plies of the bag. In preferred constructions, a microwave interactive construction or susceptor 40 will be positioned between plies of the bag, as described below.

The microwave interactive material preferably comprises metallized polyester (40*a* FIG. 7) such as Hoechst Celanese polyester film (typically 48 gauge) vacuum metalized with aluminum (40*b*, FIG. 7) to give a density of 0.25±0.05 as measured by a Tobias Densitometer. A company which can prepare such a material is Reflex Technologies of North Andover, Mass., 01845. Such arrangements have been widely used in microwave popcorn constructions, for example those described in U.S. Pat. Nos. 5,650,084 and 5,044,777. In the arrangement 1 shown, FIG. 7, the microwave interactive construction 40 is oriented with the polyester film 40*a* directed outwardly and the aluminum deposit, 40*b*, directed inwardly (although it could be done in an opposite manner).

Preferably the microwave interactive construction is positioned in thermally conductive contact with a region 41, FIGS. 3 and 7, upon which the unpopped popcorn charge 43 rests, before popping is initiated. That is, the microwave interactive construction 40 is provided in thermally conductive contact with the unpopped popcorn charge 43 so that, during use, heat generated by the microwave interactive construction 40 is transferred directly to the unpopped charge 43. This is preferably done by positioning the charge 43 over the susceptor 40, with a ply 47 of the bag or package 1, FIG. 7, therebetween.

Preferably the microwave interactive construction 40 occupies at least about 20%, and typically about 20% to 40% and preferably about ⅓ (most preferably the central ⅓), of the area of the panel 13 on which it is mounted. A preferred location of the microwave interactive material is shown in FIG. 3 at center area 57.

In preferred constructions, microwave interactive construction 40 is positioned between inner and outer plies of material. That is, preferably package 1 is generally a two-ply construction, with microwave interactive material 40 positioned between the two, flexible, inner and outer, plies 47, 48, FIG. 7.

Preferred material which is used to form the outer ply 48 would be a 21 pound bleached Kraft paper (lb/ream). The sheet of paper which forms the innermost ply 47 would preferably be 23 lb. greaseproof paper. Both papers may be treated with fluorochemical material, for grease resistance. Typically, 3M fluorocarbon FC-807 can be used for this purpose. Such a material is conventional for microwave popcorn bags. The laminating adhesive between the plies of paper could be a typical conventional adhesive such as Duracet 12, available from Franklin International, Inc., of Columbus Ohio; or HB Fuller WC-3460ZZ available from HB Fuller, St. Paul, Minn. Other materials could also be used as a laminating adhesive.

A construction such as that shown in FIG. 3 would normally be packaged, for storage, prior to use, in a trifold configuration, with a trifold formed by folding along fold lines 58 and 59, with the popcorn charge centrally positioned between the folds. It is anticipated that, after manufacture, the trifold arrangement would be sealed within a moisture barrier, or overwrap, such as a 110 gauge–140 gauge biaxially oriented polypropylene wrap. When the arrangement is to be used, the wrap would be torn open and discarded, the trifold would be opened to a configuration generally as shown in FIG. 3, and be placed within a microwave oven. In FIG. 9, the trifold is shown with a trifolded end 401 depicted being folded over a main portion 402, to make a smaller package for enclosure in the overwrap. From a review of the Figs. it will be apparent that preferably there will be no popcorn in the end portion 401 being folded over.

After microwave popping, the arrangement would generally be as shown in FIGS. 4 and 5, prior to being fully opened and stood up for consumption of the popcorn. In FIGS. 4 and 5, the internal charge of popcorn is shown popped, walls 12 and 13 are shown spread apart from one another, and bottom gusset 16 is shown expanded. In addition, in vent region 68, along edges 12*d*, 13*d*, a steam vent between panels 12 and 13 has formed, as a result of internal steam pressure during the popping operation. The vent 68 allows for venting of heat and steam from interior 69 the package 1, during a popping operation.

The preferred configuration for the construction of the package 1 depicted in FIGS. 1–5 results from a preferred adhesive pattern provided on the flexible construction, along with preferred folding. With respect to this, attention is directed to FIG. 6.

Figure 6:
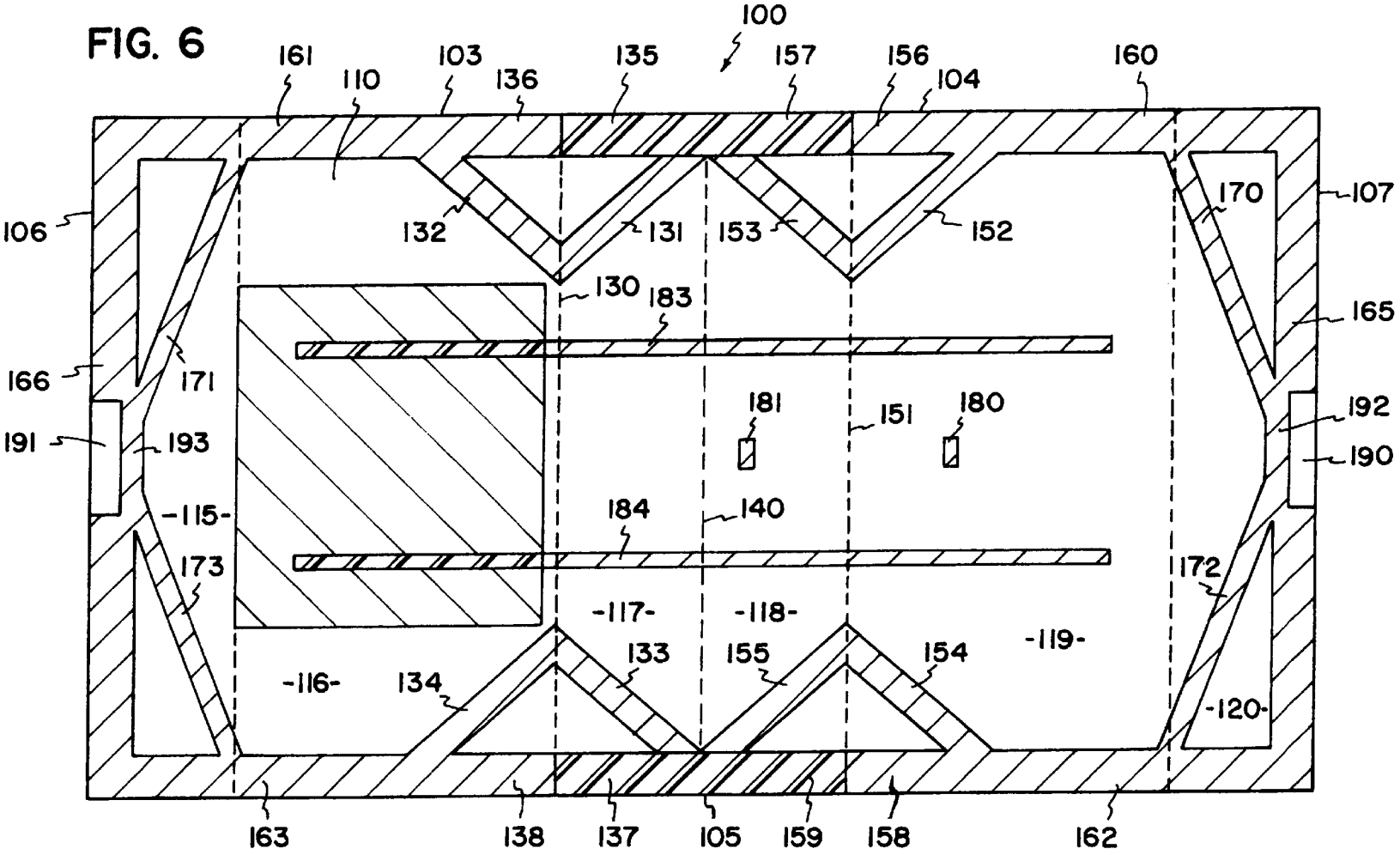
FIG. 6 is the top plan view of a sheet of flexible sheet material from which bag arrangements such as the one shown in FIGS. 1–5 can be folded; the arrangement of FIG. 6 including markings depicting where selected sealing material is preferably positioned in the construction.

In FIG. 6 a package blank 100 is depicted. The package blank 100 can be used to fold a package 1 of the type depicted in FIGS. 1–5, 7.

Referring still to FIG. 6, package blank 100 comprises a double ply sheet 103. The double ply sheet 103 is generally rectangular having first and second opposite side edges 104 and 105 and first and second opposite end edges 106 and 107. The surface 110 of sheet 103 depicted in FIG. 4 forms the inside surfaces 90 of the package 1, FIGS. 1 and 7. The opposition side of the sheet 103 from that viewable in FIG. 6, would form the exterior surfaces 91 of the package 4, FIG. 7.

Referring to FIG. 6, in general, sheet 103 includes panel sections or regions 115, 116, 117, 118, 119 and 120. The panels 115–120 are oriented adjacent to one another, in a row in the order identified. After folding, regions 117 and 118 form walls of the two-walled gusset 16, FIG. 7. Also after folding, as described below, regions 115 and 116 are overlapped by regions 120 and 119, to form first and second opposite panels 13 and 12 respectively. When such folding occurs, end edges 106 and 107 form edge 129, FIG. 7; and side edges 104 and 105 form seals 21, 20 respectively, FIG. 1.

In general, appropriate folding of sheet 103 to generate package 1 is as follows: Section 117 is folded over section 116 along fold line 130, FIG. 7. This brings sealant field 131 into overlap with sealant field 132; and, sealant field 133 into overlap with sealant field 134. Further, side seal portion 135 is brought into overlap with portion 136 and side seal portion 137 is brought in overlap with 138. The panel or wall 118 is folded back along fold line 140. When such occurs, the region of sheet 103 along fold line 140 will form internal edge 141 of gusset 16, FIG. 7. (In general, in use heat is applied to overlapped sealant fields to cause a seal.)

Section 119 is folded over wall 118, along fold line 151. This will bring sealant field 152 into overlap with sealant field 153; sealant field 154 into overlap with sealant field 155; side sealant region 156 into overlap with sealant region 157; and side sealant region 158 into overlap with region 159. In addition, side region 160 will overlap side region 161; and side region 162 will overlap side region 163. Further, end region 165 will be brought into overlap with end region 166; and corner region 170 will overlap corner region 171 and corner region 172 will overlap corner region 173. With application of appropriate heat along the regions indicated, the overlapping sealant fields will form regions of adherence between the various adjoining (overlapping) sections of sheet 103. In addition to the sealant regions described, note that between section 119 and wall section 118 there will be tack as a result of overlap between sealant regions 180 and 181. Also note sealant fields 183 and 184, portions of which will overlap during the folding, to achieve advantages described below.

In FIG. 6, certain preferred shapes, sizes and directions of sealant fields are provided. Advantages from these will be apparent from the following descriptions.

Attention is first directed to the portion of the blank 100, FIG. 6, indicated at reference no. 135 and 137. In these portions, designated by double lines, sealant fields are also located both on the back side of the blank 100, (i.e. the underside as viewed in FIG. 6) and the upper side 103. Sealant on the underside in this location will seal side edges of the resulting gusset 16 to one another, to form the type of base depicted in FIGS. 2 and 5, upon expansion.

Attention is now directed to the diagonal sealant fields 131 and 132. When region 131 is folded over 132, and adhesively sealed, a type of diagonal or "corner" seal is formed in the resulting package 1. The corner seal is between panel 117 of the gusset 16 and section 116 of the side panel, along a corner between the two. An analogous, but oppositely positioned, corner seal is provided by the overlap between regions 133 and 134. Diagonal or comer seals resulting from fields 131, 132 and 133, 134, between panel section 116 and gusset wall 117 serve numerous functions. For example, they help ensure that the package remains collapsed in this location, prior to popping. Thus, the popcorn carriage cannot readily expand into the region between the gusset wall 117 and the face panel 116. This means that during manufacture, storage and the initial portions of the popping operation, the popcorn charge is more readily centered over the microwave interactive construction and prevented from expanding substantially from that location. Also, these corner seals ensure that when the bag 1 is expanded, the gusseted base 8 opens into desirable shape.

An additional pair of corner seals is located between gusset wall section 118 and panel section 119. These corner seals are provided by the overlap of regions 152 and 153, with an opposite corner seal provided by overlap between regions 154 and 155.

The overlap of regions 131, 132; 133, 134; 152, 153, and 154, 155 provided for first, second, third and fourth comer seals positioned between the first and second panels, and the base gusset 8 oriented therebetween. These first, second, third and fourth comer seals collectively help provide for a bag having a desirable gusseted bottom, when expanded, of the type generally shown in FIGS. 2 and 5.

Attention is now directed to the overlap which will result, during folding, between diagonal sealant field 170 and diagonal sealant field 171, as well as diagonal sealant field 172 and diagonal sealant field 173. These four sealant fields will overlap to generate two diagonal comer seals. These diagonal comer seals will tend to direct steam pressure to help vent during popping.

Attention is now directed to the fin seal 199, FIGS. 4 and 7, which results from overlapping of the sealant field 165 at end 107 with the sealant field 166 at end 106 (FIG. 6). Each of these two sealant fields includes a central, no seal, pocket or vent region 190, 191 therein, FIG. 6. After the fin seal 199 is generated, in the region 190, 191, an unsealed "pocket" will be present. This pocket will generate a thin area 192, 193 in the resulting construction, which will be overcome under heat and steam pressure during a popping operation, to generate a vent (see vent 68, FIG. 4).

Attention is now directed to sealant fields 180 and 181. During folding, these will overlap, and can be sealed by heat. The result will be a tack seal between wall 118 of the gusset 16 and panel 119. This will help keep the bag collapsed in this region, to inhibit migration (into the area between panel section 119 and gusset wall 118) of any undesired amount of the popcorn charge, during manufacture and storage.

Attention is now directed to the line seals 183 and 184. In the unfolded construction, preferably the line seals 183 and 184 extend generally parallel to one another, and substantially orthogonal to edges 106 and 107, as well as orthogonal to what will become the "bottom" edge of the bag construction, defined along folded lines 130 and 151.

The line seals 183 and 184 include portions which extend over the microwave interactive construction, spaced generally about 3.5 to 4 inches apart (i.e. in a position to keep the popcorn charges between fold lines 58, 59). During folding, other portions of the same line seal will overlap in this region, adhering the panel 119 to the panel 116 at this location, forming a pocket therebetween. Preferably the unpopped popcorn charge is located in the pocket defined between the line seals 183 and 184, in this region. The line seals 183, 184 help retain the popcorn charge in the desired centralized location, during storage and manufacture, and also during initial stages of the popping operation. In addition, they allow the package to be formed and folded on a continuous motion rotary wheel.

Note that the line seals 183 and 184 also include portions that extend across the gusset walls 117 and 118. These portions will also seal to adjoining panels, facilitating the construction and containing the popcorn charge as desired.

In general, seals in the regions defined by sealant fields 171, 173, 193, 183, 184, 170, 172, 192, 180 and 181 are relatively thin and are located immediately adjacent area where substantial heat and steam will be formed, during popping. It is anticipated that under the heat and steam generated during popping, the seals will weaken and open somewhat. However, in general the corner seals, generated by regions 131, 132; 133, 134; 152, 153; and 154, 155 are further removed from the immediate vicinity of the heat and steam and will retain their integrity even during the popping operation, to provide desirable features in the overall bag. This is also true for seals formed along the edges by fields 160, 161 and 162, 163 as well as in the region of overlap in areas 135 and 137, on both sides of the blank 100.

It will be understood that the configurations of the structure, for example the corners, resulting from the sealant fields described herein could be achieved, in some instances, with discontinuous sealant fields. For example, sealant field 134 could be discontinuous (a series of dots for example) with an analogous comer structure resulting. Also, in some instances depending on the sealant a good heat seal could be formed from a sealant pattern that doesn't require two fields to overlap.

A SPECIFIC, PREFERRED, CONSTRUCTION

Figure 8:
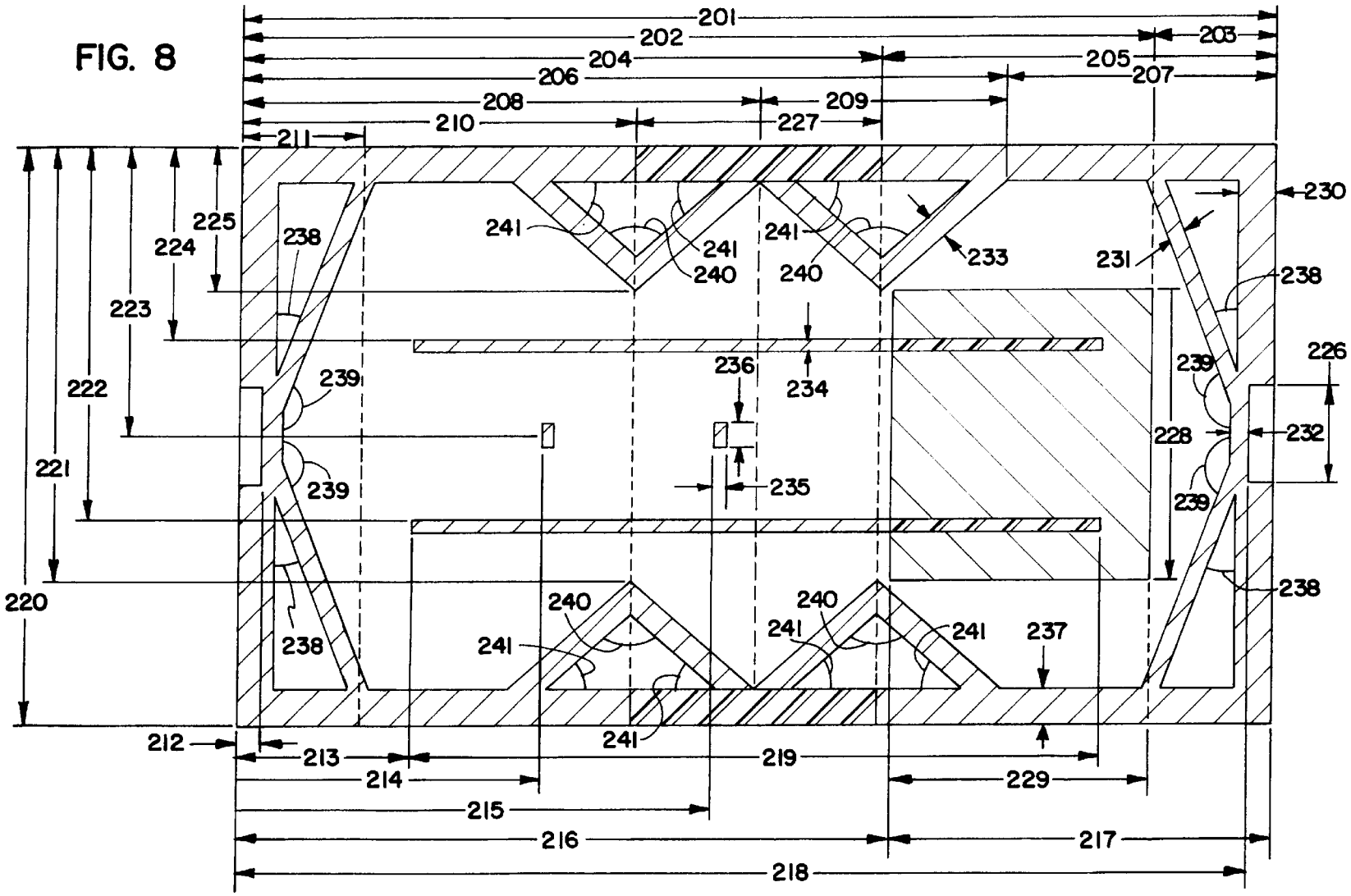
FIG. 8 is a view analogous to FIG. 6 but depicted to show dimensions of a particular preferred arrangement.

Attention is directed to FIG. 8. In FIG. 8, one preferred construction for a blank 100 as depicted in FIG. 6, is shown. In this section, specific constructions including dimensions are described. Of course, many arrangements can be made, in accordance with principles of the invention as described herein. A table is presented below. In the table, there is a list of the reference numerals shown in FIG. 8. The reference numerals correspond with preferred dimensions, as indicated. Next to the reference numerals, are typical, or preferred, dimensions for the section.

| Reference Number | Preferred Dimension |
|---|---|
| 201 | 21.0 in. (about 53.3 cm) |
| 202 | 18 1/2 in.(about 47.0 cm) |
| 203 | 2 1/2 in. (about 6.4 cm) |
| 204 | 13.0 in. (about 33.0 cm) |
| 205 | 8.0 in. (about 20.3 cm) |
| 206 | 15 1/2 in.(about 39.4 cm) |
| 207 | 5 1/2 in. (about 14.0 cm) |
| 208 | 10 1/2 in. (about 26.7 cm) |
| 209 | 5.0 in. (about 12.7 cm) |
| 210 | 8.0 in. (about 20.3 cm) |
| 211 | 2 1/2 in. (about 6.4 cm) |
| 212 | 1/2 in. (about 1.3 cm) |
| 213 | 3 1/2 in. (about 8.9 cm) |
| 214 | 6 1/8 in. (about 15.6 cm) |
| 215 | 9 5/8 in. (about 24.4 cm) |
| 216 | 13 1/4 in. (about 33.7 cm) |
| 217 | 7 3/4 in. (about 19.7 cm) |
| 218 | 20 1/2 in. (about 52.1 cm) |
| 219 | 14.0 in. (about 35.6 cm) |
| 220 | 12.0 in. (about 30.5 cm) |
| 221 | 9.0 in. (about 22.9 cm) |
| 222 | 8.0 in. (about 20.3 cm) |
| 223 | 6.0 in. (about 15.2 cm) |
| 224 | 4.0 in. (about 10.2 cm) |
| 225 | 3.0 in. (about 7.6 cm) |
| 226 | 2.0 in. (about 5.1 cm) |
| 227 | 5.0 in. (about 12.7 cm) |
| 228 | 6.0 in. (about 15.2 cm) |
| 229 | 5 1/4 in. (about 13.3 cm) |
| 230 | 3/4 in. (about 1.9 cm) |
| 231 | 3/8 in. (about 1.0 cm) |
| 232 | 3/8 in. (about 1.0 cm) |
| 233 | 3/8 in. (about 1.0 cm) |
| 234 | 1/4 in. (about 0.6 cm) |
| 235 | 1/4 in. (about 0.6 cm) |
| 236 | 1/2 in. (about 1.3 cm) |
| 237 | 3/4 in. (about 1.9 cm) |
| 238 | 20° |
| 239 | 340° |
| 240 | 96° |
| 241 | 42° |

A preferred construction would be made of the materials described herein above, with dimensions as indicated in the table above with respect to FIG. 8. Preferably the popcorn charge for such an arrangement would include an amount of popcorn, unpopped, of about 72 grams of corn (or 80 grams in some instances). It would be mixed with whatever amount of oil/fat, flavorant or other adjuvants are desired for the particular product involved. The popcorn charge would be centrally located as described hereinabove, and as depicted in FIG. 7. It is anticipated that such a construction could be used to provide a pop volume of about 3200–3500 cubic centimeters (typically approx. 3400 cc) in the final product. The stand up pouch resulting, after expanding, would have an open "mouth" at the top about 8 inches long (in the dimension between side edges 20, 21, FIG. 1), and, when expanded, about 5 inches wide.

Typically, the construction will be configured (if it differs from the specific size given above) such that its ratio of width to height (orientation of FIG. 1) is within the range of 1:1 to 2:1, typically about 1.25–1.75/1, the preferred on being 1.5:1. Preferably it is 8–16 inches wide (most preferably 10–14 inches, dimension 220, FIG. 8) and 6–10 inches tall, most preferably about 8 inches (dimension 210 in FIG. 8).

We claim:

1. A microwave popcorn bag arrangement comprising:

(a) a flexible bag resulting from a single folded sheet construction; said bag including: first and second panels; and, a base gusset portion;

(i) said first panel having first and second, opposite, end edges and first and second, opposite, side edges;

(ii) said base gusset panel having first and second, opposite, end edges and first and second, opposite, side edges;

(iii) said base gusset portion comprising an inwardly directed gusset fold positioned along said first end edges of said first and second panels and oriented between said first and second panels;

(b) a microwave interactive construction positioned on said first panel;

(c) said first panel being releasably sealed to said second panel along at least a portion of said second end edges of said first and second panels;

(d) said first panel being sealed to said second panel along portions of said first and second side edges;

(e) said base gusset being expandable to form a base to support said bag arrangement in a stand-up position with said base oriented as a bottom and with said first and second panels directed upwardly; and (f) a charge of unpopped popcorn positioned on said first panel over said microwave interactive construction and in thermally conductive contact with said microwave interactive construction.

2. A microwave popcorn bag arrangement according to claim 1 wherein:

(a) said flexible bag results from a single folded sheet construction having inner and outer plies with said microwave interactive construction positioned between said inner and outer plies.

3. A microwave popcorn bag arrangement according to claim 1 wherein:

(a) said first panel second end and said second panel second end are sealed to one another by a fin seal including a central, vent-forming, unsealed pocket therein.

4. A microwave popcorn bag arrangement according to claim 3 wherein:

(a) said base gusset includes first and second wall sections joined to one another along a central fold line;

(i) said base gusset, when in a collapsed orientation, being oriented with:

(A) said base gusset first wall section secured to said first panel along first and second opposite corner seals; and (B) said base gusset second wall section secured to said second panel along third and fourth, opposite, comer seals.

5. A microwave popcorn bag arrangement according to claim 4 wherein:

(a) said first and second panels are sealed to each other by fifth and sixth, opposite, corner seals adjacent said second ends of said first and second panels.

6. A microwave popcorn bag arrangement according to claim 5 including:

(a) a tack seal between a central portion of said second panel and an adjacent portion of said base gusset second panel section, when said popcorn bag is in a collapsed configuration.

7. A microwave popcorn bag arrangement according to claim 5 including:

(a) first and second, spaced, generally parallel line seals positioned with portions thereof sealing between said first and second panels and over said microwave interactive construction;

(i) said line seals extending in a longitudinal direction generally orthogonal to said second ends of said first and second panels.

8. A microwave popcorn bag arrangement according to claim 7 wherein:

(a) said first and second line seals each include a portion sealing said base gusset first wall section to said first panel.

9. A microwave popcorn bag arrangement according to claim 8 wherein:

(a) said first and second line seals each include a portion sealing said base gusset second wall section to said second panel.

10. A microwave popcorn bag arrangement according to claim 9 including:

(a) a charge of unpopped popcorn oriented within said flexible bag, over said microwave interactive construction and between said first and second line seals.

11. A microwave popcorn bag arrangement according to claim 5 wherein:

(a) said base gusset first and second wall sections are sealed to each other along opposite side edges thereof.

12. A microwave popcorn bag arrangement according to claim 5 wherein:

(a) a ratio of a length of said first and second panel second end edges to a length of said first and second panel first side edges is within the range of 1:1 to 2:1.

* * * * *